US010225645B1

(12) United States Patent
Lv

(10) Patent No.: US 10,225,645 B1
(45) Date of Patent: Mar. 5, 2019

(54) SPEAKER BOX

(71) Applicant: AAC Technologies Pte. Ltd., Singapore (SG)

(72) Inventor: Xuedong Lv, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 16/055,888

(22) Filed: Aug. 6, 2018

(51) Int. Cl.
*H04R 1/02* (2006.01)
*H04R 1/28* (2006.01)
*H04R 9/06* (2006.01)

(52) U.S. Cl.
CPC ..... *H04R 1/2811* (2013.01); *H04R 1/02* (2013.01); *H04R 9/06* (2013.01); *H04R 2499/11* (2013.01)

(58) Field of Classification Search
CPC ..... H04R 1/2811; H04R 1/02; H04R 9/06; H04R 2499/11
USPC ..... 381/345
See application file for complete search history.

(56) References Cited

U.S. PATENT DOCUMENTS

| | | | | |
|---|---|---|---|---|
| 9,226,052 | B2 * | 12/2015 | Khenkin | H04R 1/04 |
| 2009/0245565 | A1 * | 10/2009 | Mittleman | H04M 1/035 381/365 |
| 2010/0142742 | A1 * | 6/2010 | Tanaka | H04R 19/00 381/346 |
| 2011/0261986 | A1 * | 10/2011 | Murayama | G01M 3/26 381/332 |
| 2012/0202559 | A1 * | 8/2012 | Shiogama | H04M 1/035 455/550.1 |
| 2014/0093095 | A1 * | 4/2014 | Slotte | H04R 1/02 381/87 |
| 2016/0037243 | A1 * | 2/2016 | Lippert | H04R 1/023 381/166 |

* cited by examiner

*Primary Examiner* — Sean H Nguyen
(74) *Attorney, Agent, or Firm* — Na Xu; IPro, PLLC

(57) ABSTRACT

The present application discloses a speaker box, including: a housing having an accommodating space; a speaker accommodated in the accommodating space for dividing the accommodating space into a front cavity and a rear cavity; a sound passageway formed in the accommodating space for communicating the front cavity with outside of the speaker box; a leakage hole penetrating the housing for communicating the rear cavity with the outside; a first air permeable film covering the leakage hole; a sound cavity formed by the front cavity and the sound passageway; an auxiliary leakage hole penetrating the sound passageway for communicating the rear cavity with the sound passageway; and a second air permeable film covering the auxiliary leakage hole.

6 Claims, 2 Drawing Sheets

SPEAKER BOX

FIELD OF THE PRESENT DISCLOSURE

This disclosure related to the field of electro-acoustic transducers, and more particularly to a speaker box used in a portable electronic device, like a mobile phone.

DESCRIPTION OF RELATED ART

Mobile phones are widely and popularly used portable electronic devices. One of the attractive functions of the mobile phones is high performance music play back. In order to achieve the above mentioned function, speaker boxes are normally equipped in the mobile phones to convert electrical signals into audible sound waves. Speaker boxes with water-proof ability are now more and more popular.

A related speaker box generally includes a housing having an accommodating space for receiving a speaker therein. The housing forms a sound passageway communicated with the accommodating space, and a leakage hole covered by an air permeable film. The speaker divides the accommodating space into a front cavity and a rear cavity, and the sound passageway communicates the front cavity with the outside. While, the leakage hole communicates with the rear cavity.

When the speaker box is mounted in the electronic device, the leakage hole will communicate with the space formed in the electronic device via the air permeable film. The air in the space formed in the device will enter the rear cavity via the air permeable film, and as a result, acoustic performance of the box will be badly affected because the diaphragm of the box will be force to be deformed.

Therefore it is necessary to provide an improved speaker box for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
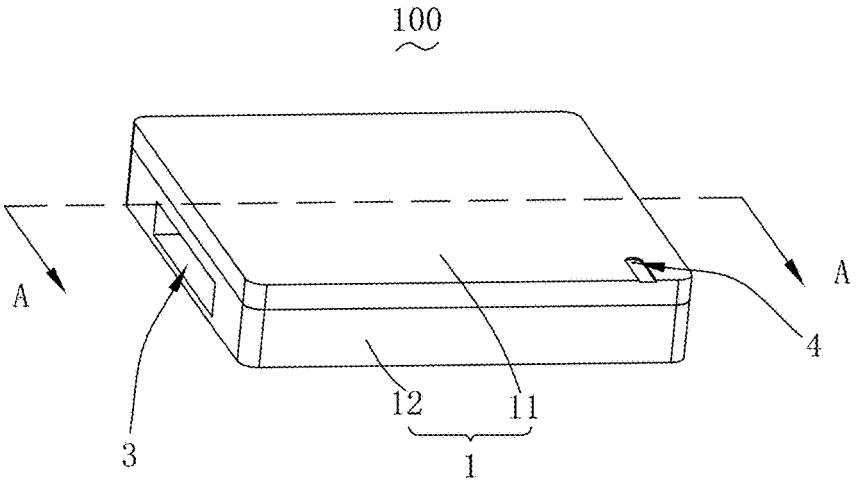
FIG. 1 is an isometric view of a speaker box in accordance with an exemplary embodiment of the present disclosure.
Figure 2:
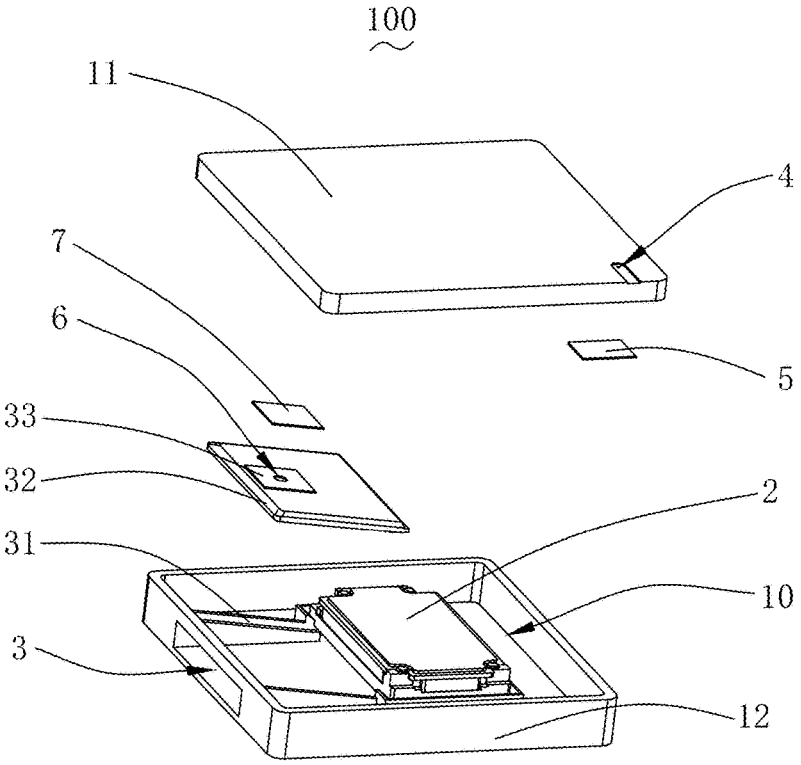
FIG. 2 is an exploded view of a selected part of the speaker box in FIG. 1.
Figure 3:
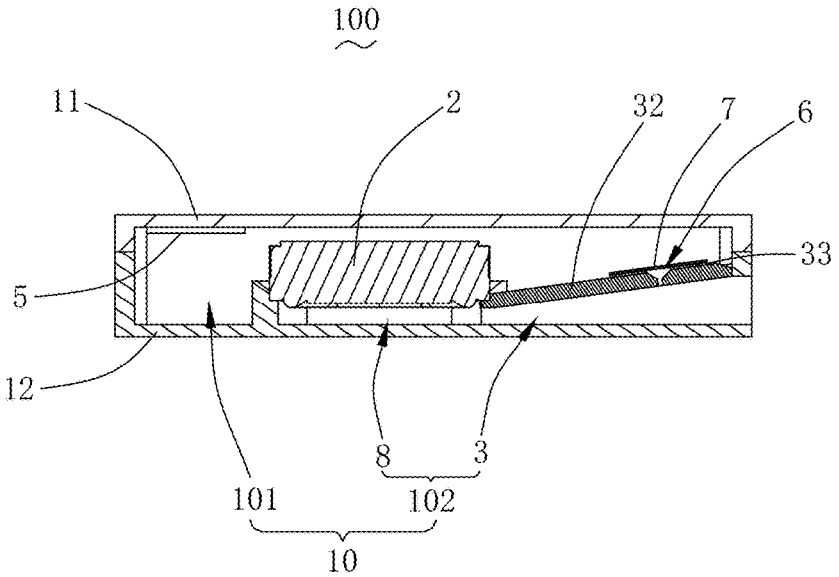
FIG. 3 is a cross-sectional view of the speaker box in FIG. 1, taken along line A-A.

Referring to FIGS. 1-3, a speaker box 100 in accordance with an exemplary embodiment of the present disclosure, includes a housing 1, a speaker 2, a sound passageway 3, a leakage hole 4, a first air permeable film 5, an auxiliary leakage hole and a second air permeable film 7.

The housing 1 includes an accommodating space 10. In this embodiment, the housing 1 further includes a lower cover 11 and an upper cover 12 for forming the accommodating space 10 cooperatively with the lower cover 11. According to actual situation, the lower cover 11 may be integrally formed with the upper cover 12, and also may be independent from the upper cover 12.

The speaker 2 is fixed in the accommodating space 10, and divides the accommodating space 10 into a front cavity 8 and a rear cavity 101. In other words, the front cavity 8 is formed between the speaker 2 and the upper cover 12, and the rear cavity 101 is formed between the speaker 2 and the lower cover 11.

The sound passageway 2 is formed in the accommodating space 10. Optionally, the sound passageway 3 is formed in the upper cover 12. In this embodiment, the sound passageway 3 includes a channel sidewall 31 extending from the upper cover 12 toward the lower cover 11, and a plate 32 engaging with the channel sidewall 31. Also, the plate 32 may be integrated with the channel sidewall 31 for enhancing the stability of the engagement. Optionally, the plate 32 includes a protrusion 33 extending toward the lower cover 11. The sound passageway 3 communicates the front cavity 8 with the outside of the speaker box for forming a side-port sound transmitting structure.

The front cavity 8 and the sound passageway 3 form a sound cavity 102 for radiating sound, and the rear cavity 101 is used for improving the low-frequency acoustic performance. The leakage hole 4 penetrates the housing 1 for communicating the rear cavity 101 the outside to balance the air pressure in the rear cavity 101.

In this embodiment, the leakage hole 4 penetrates the lower cover 11, and the shape of the leakage hole 4 is not limited to the shape shown in the drawings.

The first air permeable film 5 covers the leakage hole 4. In this embodiment, the first air permeable film 5 is fixed on a surface of the lower cover 11 adjacent to the upper cover 12. The first air permeable film 5 could be fixed to the lower cover 11 by adhesive, soldering, or other means. The auxiliary leakage hole 6 penetrates the sound passageway 3, and communicates the rear cavity 101 with the sound passageway 3, which means that the auxiliary leakage hole 6 communicates the rear cavity 3 and the outside via the sound passageway 3.

In this embodiment, the auxiliary leakage hole 6 penetrates the plate 32. Also, the auxiliary leakage hole 6 could be formed in the protrusion 33.

A cross-section of the auxiliary leakage 6 is gradually reduced along a direction from the rear cavity 101 toward the sound passageway 3. In fact, the reduction of the cross-section of the auxiliary leakage 6 is not strictly gradually configured, as long as the cross-section of the auxiliary leakage hole 6 adjacent to the rear cavity 101 is greater than the cross-section of the auxiliary leakage hole 6 adjacent to the sound passageway 3. The second air permeable film 7 completely covers the auxiliary leakage hole 6. In this embodiment, the second air permeable film 7 is fixed to the plate 32 adjacent to the lower cover 11 for improving the stability of the second air permeable film 7. In fact, the second permeable film 7 could also be fixed to the protrusion 33, according to the position of the auxiliary leakage hole 6.

The second air permeable film 7 could be fixed to the plate by adhesive, soldering, or other means. Optionally, the second air permeable film 7 is made of water-proof material for ensuring the water-proof function.

Figure 4:
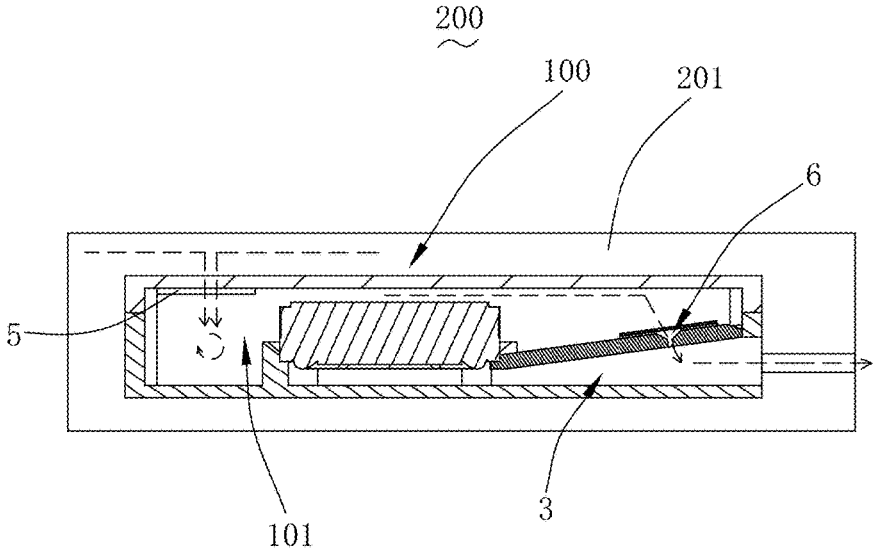
FIG. 4 is an illustrative view of an electronic device equipped with the speaker box in FIG. 1.

Referring to FIG. 4, the speaker box 100 is used in an electronic device 200, like a mobile phone. The electronic device 200 includes an internal room 201 for accommodating the speaker box 100, and the leakage hole 4 communicates with the internal room 201.

When the air pressure in the internal room 201 is normal, the air in the back cavity 101 will be balanced by the leakage hole 4 and the first air permeable film 5. And, at the same time, no air flows via the auxiliary leakage hole 6.

When the electronic device 200 is pressed by external force, or the air pressure in the internal room 201 is unbalanced, the air in the internal room 201 will enter the rear cavity 101 via the leakage hole 4 along the direction shown by arrows in FIG. 4. Meanwhile, the air in the rear cavity 101 flows along the sound passageway 3 via the auxiliary leakage hole 6 for balancing the air pressure, and further for improving the acoustic performance of the speaker box.

Compared with the related technologies, the speaker box in the embodiment forms a leakage hole covered by a first air permeable film, and an auxiliary leakage hole covered by a second air permeable film. When the electronic device is pressed by external force, or the air pressure in the internal room is unbalanced, the air in the internal room will enter the rear cavity via the leakage hole. Meanwhile, the air in the rear cavity flows along the sound passageway via the auxiliary leakage hole for balancing the air pressure.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box, comprising:

a housing having an accommodating space;

a speaker accommodated in the accommodating space for dividing the accommodating space into a front cavity and a rear cavity;

a sound passageway formed in the accommodating space for communicating the front cavity with outside of the speaker box;

a leakage hole penetrating the housing for communicating the rear cavity with the outside;

a first air permeable film covering the leakage hole;

a sound cavity formed by the front cavity and the sound passageway;

an auxiliary leakage hole penetrating the sound passageway for communicating the rear cavity with the sound passageway; and a second air permeable film covering the auxiliary leakage hole, wherein the housing comprises a lower cover and an upper cover cooperatively forming the accommodating space, the front cavity is formed between the speaker and the upper cover, the rear cavity is formed between the speaker and the lower cover, the sound passageway is formed in the upper cover and includes a channel sidewall extending from the upper cover toward the lower cover and a plate engaging with the channel sidewall, the plate includes a protrusion extending to the lower cover, the auxiliary leakage hole is formed in the protrusion and penetrates the plate, the second air permeable film is fixed to the protrusion according to the auxiliary leakage hole.

2. The speaker box as described in claim 1, wherein the plate is integrally formed with the channel sidewall.

3. The speaker box as described in claim 1, wherein a cross section of the auxiliary leakage hole is gradually reduced along a direction from the rear cavity toward the sound passageway.

4. The speaker box as described in claim 1, wherein a cross section of the auxiliary leakage hole adjacent to the rear cavity is greater than a cross section adjacent to the sound passageway.

5. The speaker box as described in claim 1, wherein the leakage hole penetrates the lower cover, the first air permeable film is fixed to a surface of the lower cover adjacent to the upper cover.

6. The speaker box as described in claim 1, wherein the second air permeable film is made of water-proof material.

* * * * *